US006926147B2

(12) United States Patent
Holley, Jr.

(10) Patent No.: US 6,926,147 B2
(45) Date of Patent: Aug. 9, 2005

(54) CUP DISPENSER

(75) Inventor: John M. Holley, Jr., Lawrenceville, GA (US)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 53 days.

(21) Appl. No.: 10/735,095

(22) Filed: Dec. 11, 2003

(65) Prior Publication Data

US 2005/0126946 A1 Jun. 16, 2005

(51) Int. Cl.[7] ..... B65D 75/00
(52) U.S. Cl. ..... 206/434; 206/427; 206/153
(58) Field of Search ..... 206/147, 151, 206/152, 153, 154, 155, 427, 429, 434; 229/103.2; 294/87.2

(56) References Cited

U.S. PATENT DOCUMENTS 4,570,795 A * 2/1986 Fernandez Sanz ..... 206/430
4,703,856 A * 11/1987 Chaussadas ..... 206/429
D304,017 S 10/1989 Oliff
5,351,816 A * 10/1994 Sutherland et al. ..... 206/153
5,415,278 A * 5/1995 Sutherland ..... 206/148
5,687,838 A * 11/1997 Bakx ..... 206/147
5,921,392 A * 7/1999 Davis ..... 206/434
2004/0079666 A1 * 4/2004 Bakx ..... 206/427

* cited by examiner

*Primary Examiner*—David T. Fidei
(74) *Attorney, Agent, or Firm*—Tsugihiko Suzuki

(57) ABSTRACT

A carton for dispensing articles such as cups while retaining the remaining cups in the open carton. A plurality of panels are connected together to define a carton. A bottom panel includes a plurality of article-receiving openings therethrough. The openings are configured to receive articles and to retain the articles by their top flanges. Each of the openings is disposed adjacent to a fold line connecting the bottom panel with a side panel. The fold line includes a frangible portion that is positioned in proximity of at least one of the openings. Moving each article within the respective opening permits a flange of that article to initiate breakage of the frangible portion to release that article from the respective opening so that that article may be dispensed from the carton.

17 Claims, 7 Drawing Sheets

CUP DISPENSER

TECHNICAL FIELD

The present invention relates generally to paperboard cartons for use in packaging articles and, more particularly, relates to a carton configured for dispensing articles such as cups while restraining the remaining cups.

BACKGROUND OF THE INVENTION

Cartons are useful for allowing consumers to purchase, transport and store a desired quantity of articles. Typically, in the packaging process, articles such as cups are moved along a conveyor and grouped into two or more rows with one row above the other. The grouped articles are then wrapped by a carton blank to form a package. When the carton blank is formed around the grouped articles, the articles are typically retained within the carton by flange portions extending from the top of every article. The bottoms of the lowermost row of articles typically freely extend through openings formed in a bottom panel of the carton.

Although these convenient packages are formed in an economical manner, they are often difficult for the consumer to open without unintended tears. Panels may be torn out which will lead to failure of the carton. Failure of the carton will then lead to the articles falling out of the carton prematurely.

Therefore, there is a need for an improved carton that will allow partial tearing of the carton to dispense a single article and then restrain the remaining articles within the open carton until desired by the consumer.

SUMMARY OF THE INVENTION

The present invention provides a carton configured for dispensing articles such as cups by orienting the cups to force their release from the carton while restraining the remaining cups within the open carton.

Generally described, a plurality of panels are connected together to form the dispensing carton of the present invention. A bottom panel includes a plurality of openings therethrough. The openings are configured to receive and retain the articles when the carton is erected. Each of the openings is also configured to at least border a fold line connecting the bottom panel with a side panel of the carton. A frangible portion corresponding substantially with the fold line is positioned in proximity of at least one of the openings. Orienting the article within the carton permits a portion of the article to initiate partial separation of the bottom panel from the side panel along the frangible portion to release the article from the opening and then dispense the article from the carton.

According to one aspect of the present invention, the package of the present invention further includes at least one slot positioned along a fold line connecting a side panel with a top panel of the carton. The slot is configured to receive a portion of an upper article to be retained within the carton. At least one other frangible portion, corresponding substantially with the fold line connecting the side and top panels, is positioned in proximity of the slot. Orienting the upper article within the carton permits the portion of the upper article within the slot to initiate partial separation of the side and top panels from one another along the frangible portion. The portion of the upper article is released from the slot and the upper article may then be received in a vacated opening directly below.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
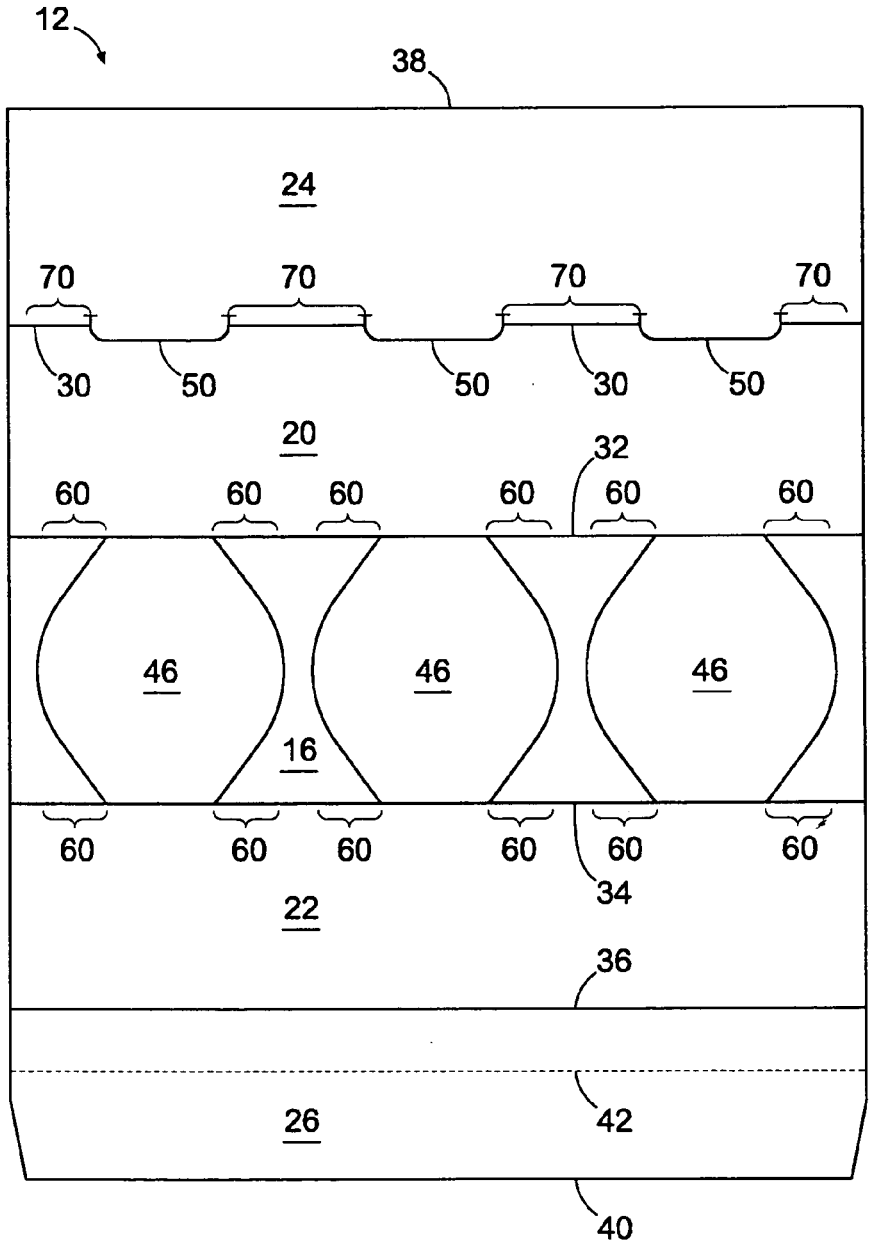
FIG. 1 illustrates a plan view of one embodiment of a blank for forming the carton of the present invention.

Referring now to the drawings in which like numerals indicate like elements throughout the several views, the drawings illustrate an exemplary embodiment of a carton 10 of the present invention. In one embodiment, the carton 10 is for dispensing articles such as food containers or cups.

Generally, the carton 10 is formed from a foldable sheet material such as paperboard blank 12 as shown in FIG. 1. The panels of the blank 12 are a bottom panel 16, a first side panel 20, a second side panel 22, a first top panel 24, and a second top panel 26. Alternatively, the blank 12 may instead include only a single top panel, similarly dimensioned to the bottom panel, rather than utilizing the combination of the first and second top panels 24, 26 for forming the top of the erected carton 10.

As shown in FIG. 1, the panels of the blank 12 are hingedly interconnected in series to one another to form the basic tubular structure of the erected carton 10. The first top panel 24 is hingedly connected to the first side panel 20 by interrupted fold line 30. The first side panel 20 is then hingedly connected to the bottom panel 16 by interrupted fold line 32. The bottom panel 16 is also hingedly connected to the second side panel 22 by an interrupted fold line 34. Lastly, the second side panel 22 is hingedly connected to the second top panel 26 by full fold line 36.

Figure 2:
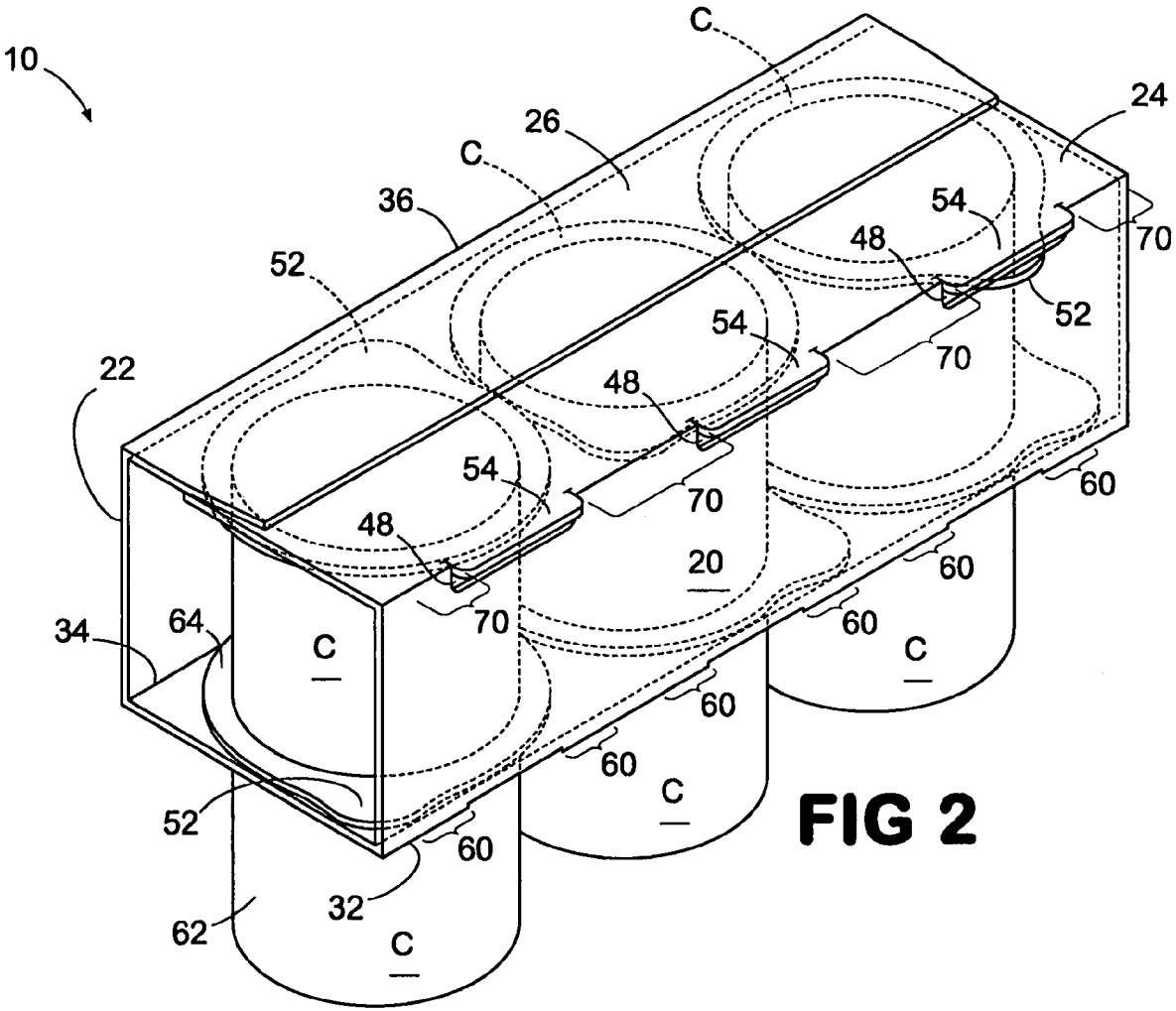
FIG. 2 is a perspective view of one embodiment of the carton of the present invention formed from the blank of FIG. 1.

Once the articles have been grouped into the desired arrangement, the blank 12 is then wrapped around the grouped articles. As best shown in FIG. 2, top panel 24 and top panel 26 are folded over to be glued or otherwise secured together to form the top of the carton 10. Top panels 24 and 26 have free side edges 38 and 40, respectively, and are preferably secured to one another in an overlapping manner. Free side edge 38 of top panel 24 corresponds with line 42 on top panel 26 to create a seam defined between the free side edges 38, 40 of top panels 24, 26. Alternatively, two opposing panels 24, 26 may be secured to one another by a locking mechanism for securing panels together.

The erected carton 10 illustrated in the drawings is adapted to hold a group of similarly dimensioned articles "C", in a plurality of vertically arranged rows or tiers. In one embodiment of the present invention, the number of the rows or tiers is two (2) and each row includes three articles C. However, it is contemplated that the number of the rows may be three or more and each row may include any number of articles C.

Each article C typically has a downwardly tapered cylindrical side wall 62 and an integral top flange 64 protruding radially outwardly from the upper end of the side wall 62. The articles C of the lowermost row may be received in openings 46 in the bottom panel 16 and then be retained in the openings 46 by their top flanges 64. The openings 46 extend the full width of the bottom panel 16 such that each opening 46 border each of the fold lines 32, 34. Typically, the flanges 64 of the articles C are non-circular and hang on the portions of the bottom panel 16 defining the peripheries of generally circular openings 46. The non-circular flange of each article used with the carton of the illustrated embodiment has an integral tab portion 52 protruding radially outwardly. However, articles with circular flanges may also be used with the present invention as described later in more details.

Figure 3:
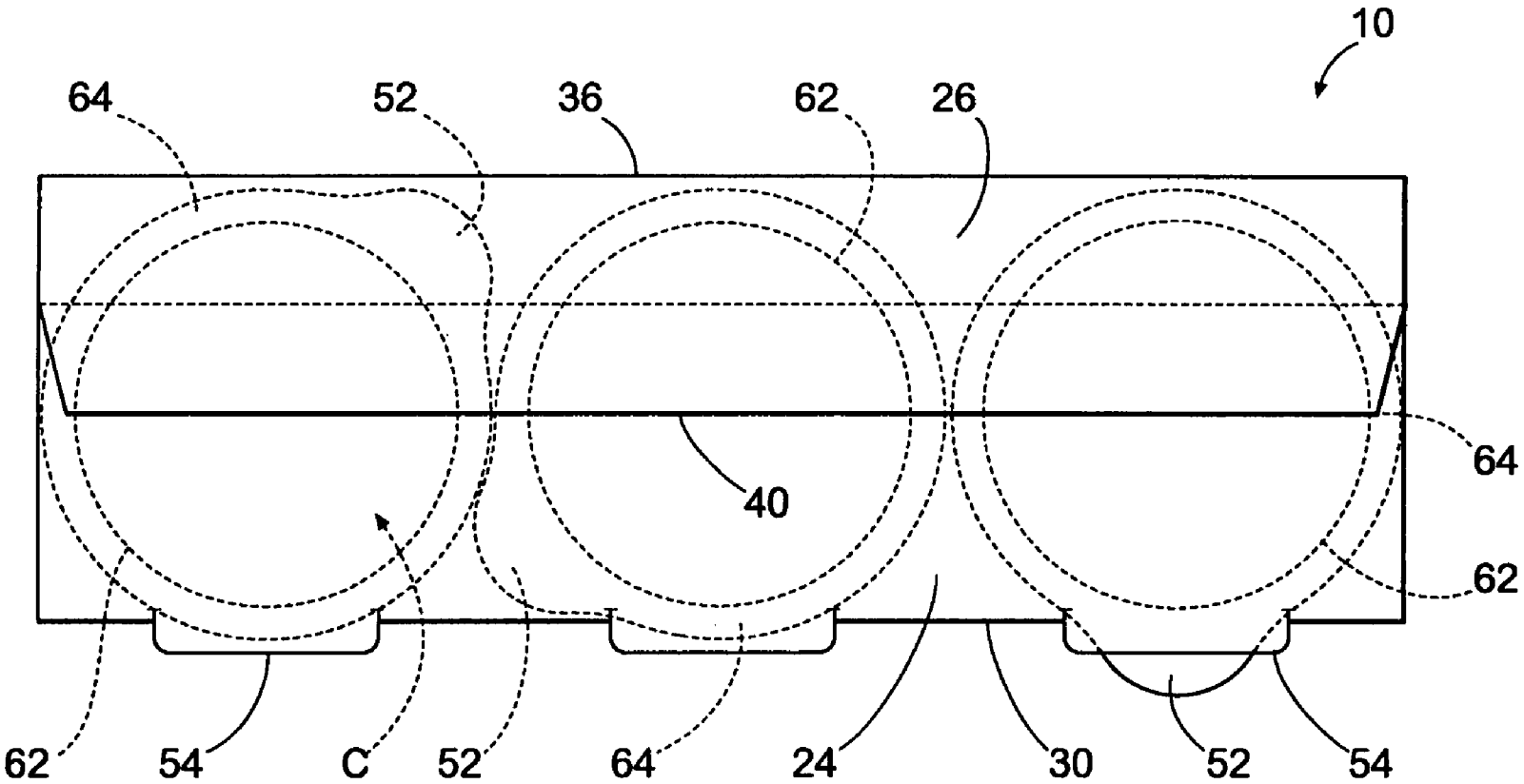
FIG. 3 is a top view of the carton of FIG. 2.

In an alternative process for packaging articles, the lowermost row of articles is first placed in the openings 46 of the carton 10, and another row of articles C may then be stacked on top of the lowermost row of articles C. The upper row or rows of articles C are restrained within the carton 10 because portions of the flanges 64 of these articles C are received and retained in slots 48 (FIGS. 2 and 5) defined by cuts 50 in the blank 12. The slots 48 are preferably evenly spaced along either or both of the fold lines 30 or 36. In the illustrated embodiment, as best shown in FIG. 2, the slots 48 are formed along the fold line 30 only and the flanges 64 of the articles C in the upper row extend through the slots 48. These articles C are randomly oriented and therefore the tab portion 52 or the other portion of each flange 64 may be received in the respective slot 48. The portion of each flange 64 received in the respective slot 48 is at least partially covered by a short tab 54 extending outwardly from of the top panel 24, as best shown in FIG. 3. Alternatively, slots for receiving the flanges 64 may be positioned along the fold line 36 or along both the fold lines 30 and 36.

Figure 4:
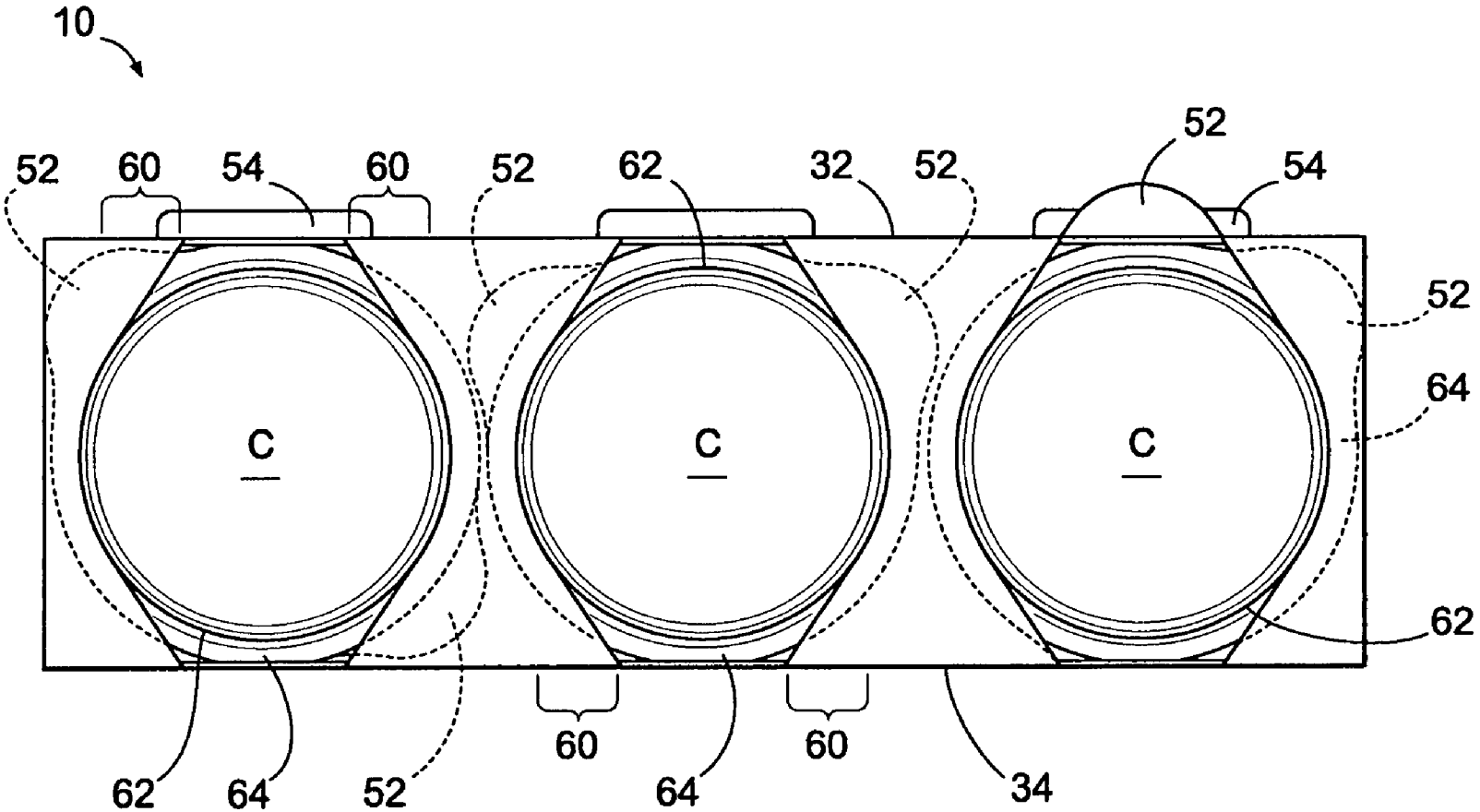
FIG. 4 is a bottom view of the carton of FIG. 2.

Because each of the openings 46 extends the full width of the bottom panel 16 as best shown in FIG. 4, the flanges 64 of the articles C in the lowermost row project outward from the carton 10 without the need for slots in the side panels 20 and 22. Needless to say, the diameter of the flange 64 is greater than the width of the bottom panel 16 so that the articles in the lowermost row can be retained within the carton. The tab portion 52 or the other portion of the flange 64 of each article in the lowermost row may be received in the respective opening 46; the tab portion 52 of the flange 64 of each article may be concealed within the carton 10 or may be exposed through the respective opening 46.

Figure 5:
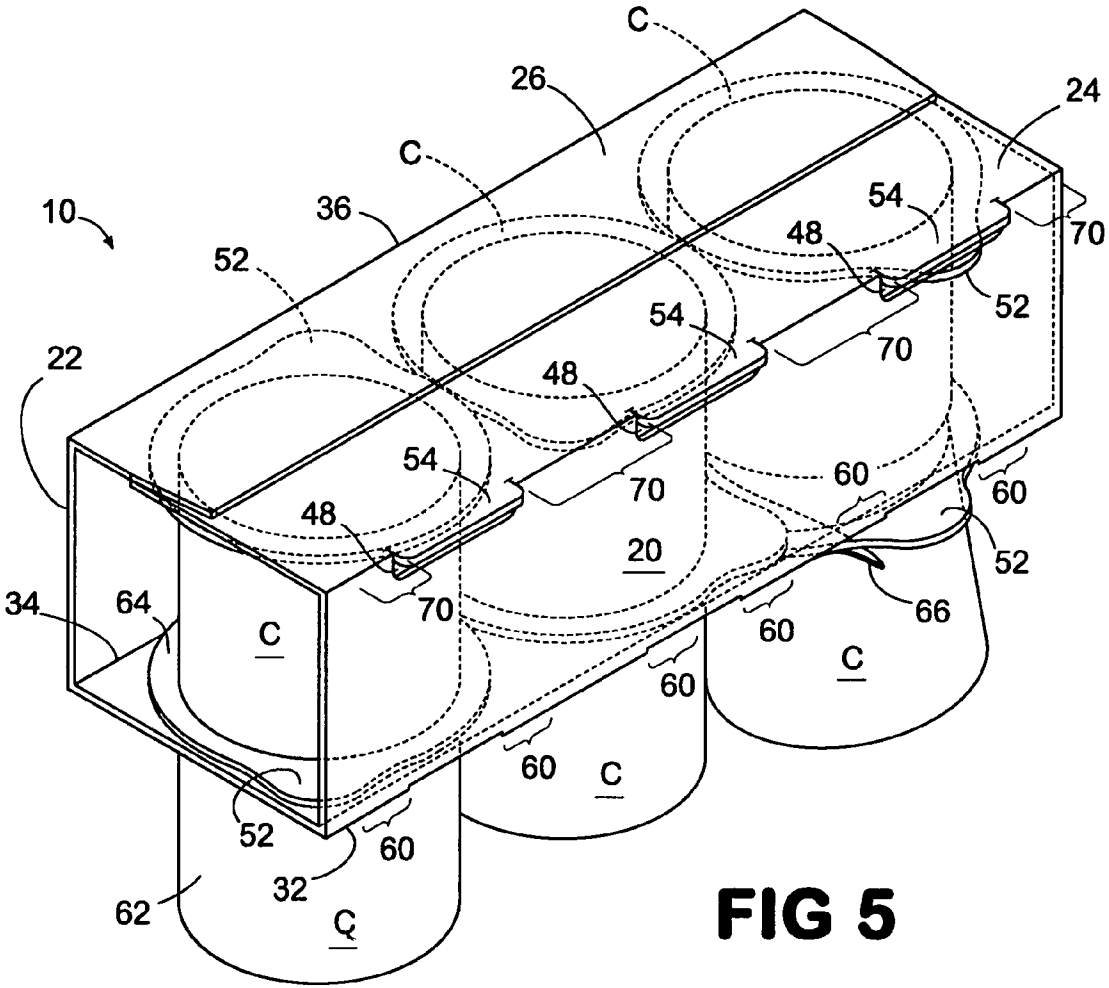
FIG. 5 is a perspective view of the carton of FIG. 2 depicting an article twisted to break the adjacent frangible portion in order to dispense the article from the carton.
Figure 6:
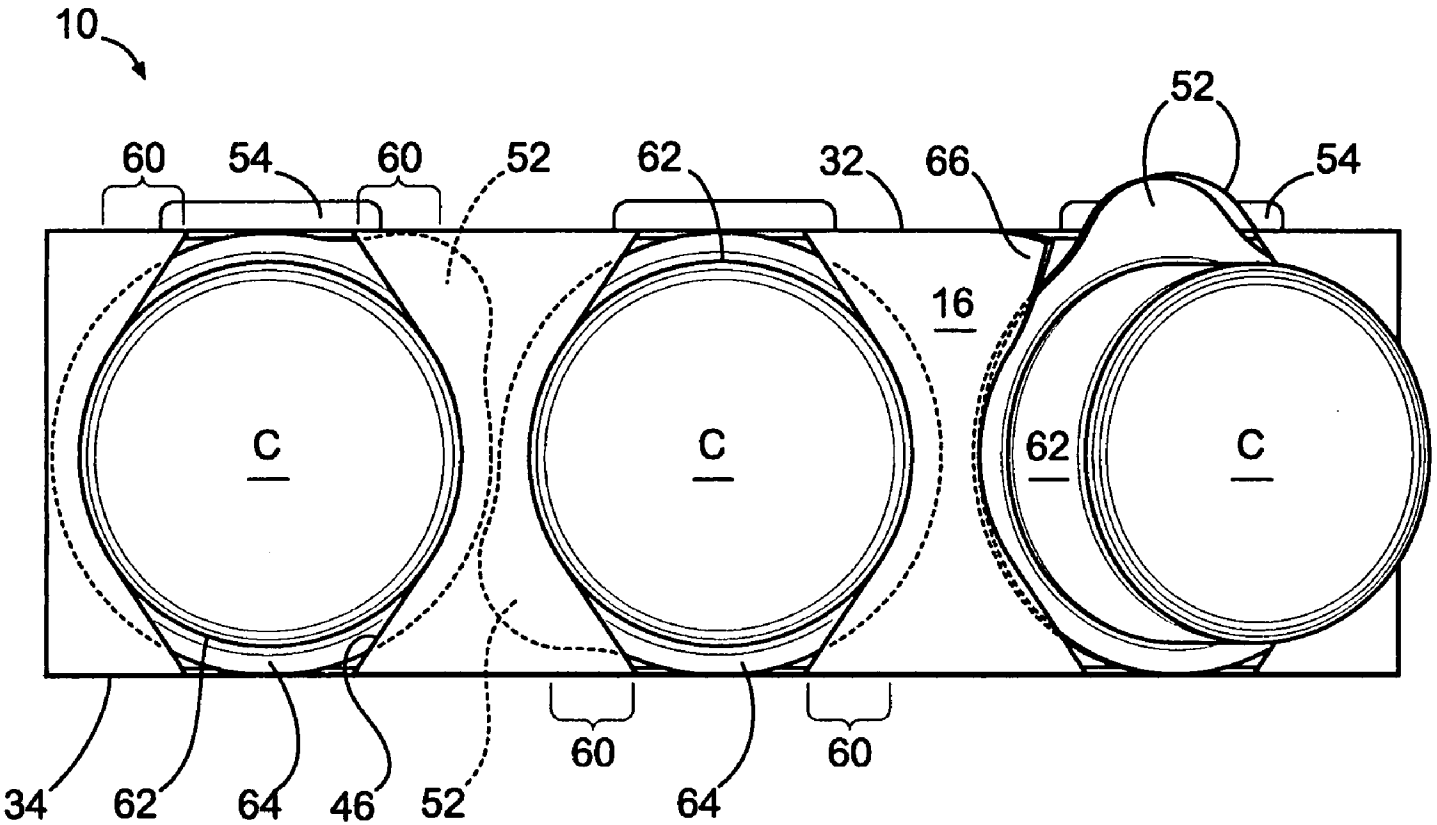
FIG. 6 is a bottom view of the carton of FIG. 5.

Turning now to FIGS. 5 and 6, the carton 10 of the present invention dispenses an article C from one of the openings 46 by urging the flange 64 against the carton 10 to cut the carton along either fold line 32 or 34 to enlarge the respective opening 46 so that the respective opening becomes large enough to permit the article C to pass unobstructed through the respective opening 46. Larger openings 46 are created by placing a frangible portion 60 in close proximity of each of the openings 46 such that moving each article C in the lowermost row with respect to the carton 10 in a particular manner initiates a controlled partial tearing of the carton 10 along the frangible portion 60. The preferred manner of moving the article C is to twist and/or turn the article C to be dispensed about its cylindrical axis within the respective opening 46 so that the tab portion 52 of the respective flange 64 is urged against an adjacent frangible portion 60. Such movement breaks the adjacent frangible portion or portions 60 such that the article C may be pulled sideways to exit the carton 10 through an enlarged opening 46. Preferably, each frangible portion 60 emanates from the adjacent opening 46 and extends substantially coincidentally with either the fold line 32 or 34 so that severance of the carton along each frangible portion 60 at least partially separate the bottom panel 16 from either of the side panels 20, 22.

Each frangible portion 60 may be any weakened line that facilitates separation of the panels or portions of a panel lying on either side of the frangible portion 60. It is contemplated that a frangible portion includes, but is not limited to, a tear strip, a line of perforations, a score line, a line of short slits or cuts, a half cut or any combination of the same, or the equivalent.

In one embodiment of the present invention, each frangible portion 60 is displaced and/or spaced from any other frangible portion 60 so that dispensing an article C by breaking an adjacent frangible portion 60 does not result in an uncontrolled continuous or chain breakage of other frangible portions 60 that would leads to failure of the carton 10.

Still referring to FIGS. 5 and 6, the flange 64 of an article C in the lowermost row may be urged against the frangible portion 60 on either side of the opening 46. As a result of the breakage of the frangible portion 60, a portion 66 of the bottom panel 16 may be easily pulled away from the remainder of the bottom panel 16 as best shown in FIG. 6, such that the respective opening 46 is enlarged enough to allow the article to exit the carton from the bottom. No further alteration of the carton 10 when pulling on the article C is required in order to dispense the article C from the carton 10. Because only the portion 66 is slightly pulled from the bottom panel 16 of the carton 10, the remaining articles C within the carton 10 are sufficiently restrained within the carton 10.

Figure 7:
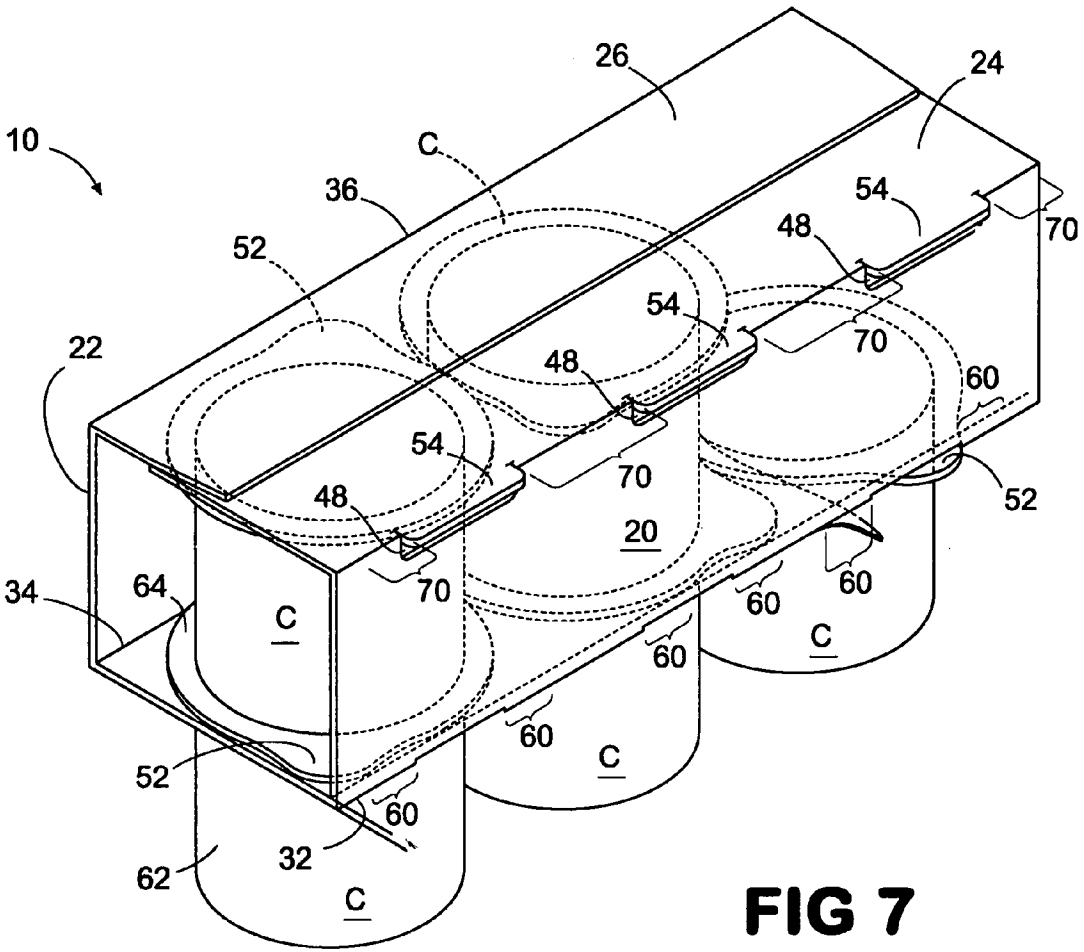
FIG. 7 is a perspective view of the carton of FIG. 5 depicting an article from an upper tier of articles having fallen into a vacated opening to replace the previously dispensed article.

As shown in FIG. 7, after an article C in the lowermost row has been dispensed as described above, another article C in an upper adjacent row may then fall into the vacated opening 46 from directly above. It may be necessary to turn or twist, or otherwise displace, the article C in the upper adjacent row so that its flange 64, the tab portion 52 in particular, is no longer retained in the slot 48. The carton 10 may include additional frangible portions 70 in close proximity to the slots 48 along fold line 30. Preferably, each frangible portion 70 extends the full distance between adjacent slots 48. Each frangible portion 70 may also be any weakened line that facilitates separation of the panels or portions of a panel lying on either side of the frangible portion 70. Each frangible portion 70 may includes, but is not limited to, a tear strip, a line of perforations, a score line, a line of short slits or cuts, a half cut or any combination of the same, or the equivalent. Displacing the articles C in the upper adjacent row urges their flanges 64 against the frangible portions 70 to initiate controlled partial breakage of the frangible portions 70 to then release the flange 64 from the enlarged slot 48.

Because the portion 66 has been only slightly displaced away from the remainder of the bottom panel 16, as explained above, the article C from above may still be retained within the carton 10 by the periphery of opening 46. Therefore, the article C may then be dispensed from the carton 10 by pulling the article C downwardly or sideways so that the flange 64 passes between the portion 66 and the side panel 20. The remaining articles C in the lowermost row may also be dispensed from the carton 10 by urging their flange 64 against the corresponding frangible portions 60. Then, the remaining articles C in the upper adjoining row may fall into the vacated openings 46 to become part of the lowermost row from where they may also be dispensed from the carton 10.

The present invention has been illustrated in relation to a particular embodiment which is intended in all respects to be illustrative rather than restrictive. Those skilled in the art will recognize that the present invention is capable of many modifications and variations without departing from the scope of the invention. For example, articles with circular flanges may also be used with the present invention. Circular flanges would also serve to initiate breakage of an adjacent frangible portion by repeatedly twisting/turning in opposite directions the respective article about its cylindrical axis while holding still the other part of the package. Accordingly, the scope of the present invention is described by the claims appended hereto and supported by the foregoing.

What is claimed is:

1. A package comprising a carton and a plurality of generally cylindrical articles accommodated in said carton, each of said articles defining a cylindrical axis and having a flange protruding radially outwardly therefrom, said carton comprising a bottom panel hingedly connected to a side panel along a first fold line, said bottom panel having a plurality of openings therethrough, each said opening being configured to receive one of said articles and retain said one article by said flange thereof, each said opening being located adjacent to said fold line, said fold line having at least one frangible portion, said one frangible portion being positioned in proximity of one of said openings such that moving a respective one of said articles within said one opening urges said flange of said respective article against said one frangible portion to initiate partial breakage of said one frangible portion to release said respective article from said carton through said one opening.

2. The package of claim 1 wherein said one frangible portion emanates from said opening.

3. The package of claim 1 wherein said fold line includes another frangible portion emanating from said one opening, said other frangible portion being arranged opposite said one frangible portion.

4. The package of claim 1 wherein said one frangible portion comprises a plurality of spaced short cut lines.

5. The package of claim 4 wherein said cut lines are in alignment with said fold line.

6. The package of claim 1 wherein said frangible portion comprises a plurality of cuts and scores.

7. The package of claim 1 wherein said frangible portion comprises a plurality of perforations.

8. The package of claim 1 wherein said flange of said each article is non-circular in configuration.

9. The package of claim 8 wherein said flange includes a radially-outwardly-protruding tab portion.

10. The package of claim 1 wherein said articles are arranged in a group of two or more tiers.

11. The package of claim 10 wherein said flange of each of said articles is disposed around an upper end of said each article, said articles in a lowermost one of said tiers are received in said openings such that said articles in said lowermost tier are retained in said openings by the flanges thereof engaged with said bottom panel, and a primary part of said each article is protruding outwardly of said carton and exposed to view.

12. The package of claim 11 further comprising:

a top panel hingedly connected to said side panel along a second fold line, at least one slot defined along said second fold line, said slot being configured to receive said flange of one of said articles in an uppermost one of said tiers to retain said one article in said uppermost tier.

13. The package of claim 12 wherein said second fold line includes at least one other frangible portion, said other frangible portion being positioned in proximity of said one slot such that moving said one article in said uppermost tier permits said flange of said one article in said uppermost tier to initiate partial breakage of said other frangible portion to release said flange of said one article in said uppermost tier from said slot.

14. The package of claim 13 wherein said other frangible portion emanates from an end of said one slot.

15. A carton formed from a single blank, said blank comprising:

a bottom panel;

a side panel connected along a first fold line to each opposing edge of said bottom panel; and a top panel connected along a second fold line to at least one of said side panels at an edge thereof opposite said bottom panel, said bottom panel, side panels, and said top panel defining an interior for receiving and retaining a plurality of articles, said bottom panel having a plurality of openings defined therein, each of said openings being configured to receive one of said articles and to retain said one article by a radially protruding flange of said one article, each of said first fold lines including at least one frangible portion, said frangible portion being positioned in proximity of said one opening such that moving said one article within one opening urges a flange of said one article against said one frangible portion to initiate breakage said one frangible portion to release said one article from said one opening when said blank is erected into a carton.

16. The package of claim 15 further comprising:

at least one slot defined along said second fold line, said slot being configured to receive said flange of another one of said articles to retain said other article within said carton.

17. The package of claim 16 wherein said second fold line includes at least one other frangible portion, said other frangible portion being positioned in proximity of said one slot such that moving said other article within said carton permits said flange of said other article to initiate breakage of said other frangible portion to release said flange of said other article from said slot.

* * * * *